US009617941B2

(12) United States Patent
Lee

(10) Patent No.: US 9,617,941 B2
(45) Date of Patent: Apr. 11, 2017

(54) METHOD FOR CONTROLLING COOLING SYSTEM IN VEHICLE

(71) Applicant: Hyundai Motor Company, Seoul (KR)

(72) Inventor: Jun Yong Lee, Seongnam-si (KR)

(73) Assignee: Hyundai Motor Company, Seoul (KR)

( * ) Notice: Subject to any disclaimer, the term of this patent is extended or adjusted under 35 U.S.C. 154(b) by 99 days.

(21) Appl. No.: 14/616,349

(22) Filed: Feb. 6, 2015

(65) Prior Publication Data

US 2016/0097336 A1 Apr. 7, 2016

(30) Foreign Application Priority Data

Oct. 1, 2014 (KR) ..... 10-2014-0132162

(51) Int. Cl.

| | |
|---|---|
| ***F02D 41/24*** | (2006.01) |
| ***F02M 26/28*** | (2016.01) |
| *F02D 41/00* | (2006.01) |
| *F02D 41/06* | (2006.01) |
| *F02D 41/14* | (2006.01) |

(52) U.S. Cl.

CPC ..... *F02D 41/2422* (2013.01); *F02M 26/28* (2016.02); *F02D 41/0065* (2013.01); *F02D 41/068* (2013.01); *F02D 41/1461* (2013.01); *F02D 2200/021* (2013.01)

(58) Field of Classification Search

CPC ..... F02D 41/0065; F02D 41/005; F02D 41/0052; F02D 41/0072; F02D 41/0077; F02D 41/0047; F02D 2041/0067; F02M 26/06; F02M 26/05

USPC ..... 123/568.11–568.32

See application file for complete search history.

(56) References Cited

U.S. PATENT DOCUMENTS

2012/0090585 A1* 4/2012 Anzawa ..... F02D 35/027 123/568.12

FOREIGN PATENT DOCUMENTS

| | | | |
|---|---|---|---|
| JP | 03-229914 | A | 10/1991 |
| JP | 11-107755 | A | 4/1999 |
| JP | 2003-120294 | A | 4/2003 |
| JP | 2004-156490 | A | 6/2004 |
| JP | 2006-161744 | A | 6/2006 |
| JP | 2009-174387 | A | 8/2009 |
| JP | 4765677 | B2 | 6/2011 |
| KR | 10-0279463 | B1 | 3/2001 |
| KR | 10-2013-0031540 | A | 3/2013 |

* cited by examiner

*Primary Examiner* — Sizo Vilakazi

(74) *Attorney, Agent, or Firm* — Morgan, Lewis & Bockius LLP

(57) ABSTRACT

A method for controlling a cooling system in a vehicle, may include an Exhaust Gas Recirculation (EGR) use determination step of determining whether to use EGR, a first coolant temperature management step of controlling a coolant temperature using a first coolant temperature map based on an output value reflecting engine operating conditions when driving the vehicle using the EGR, and a second coolant temperature management step of controlling the coolant temperature using a second coolant temperature map in which a coolant temperature of the second coolant temperature map may be set to be higher than a coolant temperature of the first coolant temperature map in a same engine operation region when driving the vehicle not using the EGR.

10 Claims, 2 Drawing Sheets

METHOD FOR CONTROLLING COOLING SYSTEM IN VEHICLE

CROSS REFERENCE TO RELATED APPLICATION

The present application claims priority to Korean Patent Application Number 10-2014-0132162 filed Oct. 1, 2014, the entire contents of which is incorporated herein for all purposes by this reference.

BACKGROUND OF THE INVENTION

Field of the Invention

The present invention relates generally to a method for controlling a cooling system in a vehicle and, more particularly, to a method for controlling a cooling system in a vehicle, which optimizes a coolant temperature according to whether to use EGR or $NO_x$ emissions to increase fuel efficiency and to reduce $NO_x$ emissions.

Description of Related Art

Developing a fuel-efficient and eco-friendly vehicle has become more important due to worldwide fuel efficiency regulations and regulations limiting $CO_2$ emissions. Leading automakers have actively researched and developed techniques for reducing vehicle fuel consumption to achieve the above goal.

Under cold conditions immediately after starting a vehicle, fuel efficiency is low even though the engine is sufficiently warmed up. That is because a high viscosity of oil increases engine friction, heavy heat loss occurs due to a low temperature of a cylinder wall, and combustion stability is decreased.

Consequently, for an increase in fuel efficiency of a vehicle, improvement in engine durability and improvement in EM (Emissions), it is necessary to quickly raise the temperature of the engine to a normal temperature when starting a vehicle.

FIG. 1 is a simplified diagram of a cooling system according to a conventional art.

Referring to FIG. 1, for controlling coolant at an outlet, a water pump 102 is installed at an inlet of an engine 101. Some of the coolant that has come into the engine 101 through the water pump is moved to an oil cooler and goes through the engine block and head. Also, a coolant temperature sensor 103 for measuring a temperature of the coolant is arranged in front of a coolant flow control valve 104.

In the cooling system configured as described above, a method for quickly raising the temperature of the coolant immediately after starting a vehicle is suggested. The method controls an amount of flow or flow channels using the coolant flow control valve 104, or performs Zero flow control that stagnates the coolant inside the engine using a clutch water pump, etc. so as not to remove heat generated inside the engine and to store the heat in the engine so as to quickly raise the temperature of the coolant. Also, after warming up the coolant, the method maintains the temperature of the engine to be higher than the previous engine temperature by controlling the raising of the coolant temperature so as to reduce heat loss and friction for improvement in fuel efficiency.

However, the above method has a problem of increased $NO_x$ production. Accordingly, to achieve improvement of fuel efficiency through controlling the raising of the coolant temperature, a target temperature of the coolant should be controlled so that the improvement of the fuel efficiency exceeds the increase of $NO_x$.

In this case, the target temperature for the coolant may be set based on a map according to an engine operating condition (rpm/a fuel use amount).

However, if the raising of the coolant temperature is controlled based on one map, it is difficult to reach the target EM level or target fuel efficiency due to variations in the surrounding environment or deterioration of the engine hardware.

For example, when an engine is operated in an EM region using EGR (Exhaust Gas Recirculation), which is an operation point of a mode used for measurement of exhaust gas, there is a limit to raising the engine temperature due to increased $NO_x$ levels, while in the high-speed, high-load non-EM region in which typically EGR is not used, it is possible to raise the temperature of the coolant within the endurance limit of the engine. Accordingly, if the raising of the coolant temperature is controlled based on one coolant temperature map without regard to whether to use EGR or $NO_x$ emissions, chances of improving the fuel efficiency may decrease.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a method for controlling a cooling system in a vehicle, which optimizes a coolant temperature according to whether to use EGR or $NO_x$ emissions to increase fuel efficiency and to reduce $NO_x$ emissions.

According to various aspects of the present invention, a method for controlling a cooling system in a vehicle, may include an Exhaust Gas Recirculation (EGR) use determination step of determining whether to use EGR; a first coolant temperature management step of controlling a coolant temperature using a first coolant temperature map based on an output value reflecting engine operating conditions when driving the vehicle using the EGR; and a second coolant temperature management step of controlling the coolant temperature using a second coolant temperature map in which a coolant temperature of the second coolant temperature map is set to be higher than a coolant temperature of the first coolant temperature map in a same engine operation region when driving the vehicle not using the EGR.

The method may further include an input step for receiving a value of $NO_x$ as an input; and a third coolant temperature management step of controlling the coolant temperature using a third coolant temperature map in which a coolant temperature of the third coolant temperature map is set to be lower than the coolant temperature of the first coolant temperature map in a same engine operation region when the value of the $NO_x$ is higher than a reference value for the $NO_x$ of a $NO_x$ map set according to an engine operation region.

The value of the $NO_x$ is determined by using a predetermined $NO_x$ model.

When the value of the $NO_x$ is lower than the reference value for the $NO_x$ of the $NO_x$ map, the coolant temperature is controlled using the first coolant temperature map.

The first coolant temperature management step controls the coolant temperature to be maintained within a first reference temperature range, wherein the second coolant temperature management step controls the coolant temperature to be maintained within a second reference temperature range that is higher than the first reference temperature range, and wherein the third coolant temperature management step controls the coolant temperature to be maintained within a third reference temperature range that is lower than the first reference temperature range.

The method may further include a warm-up determination step of determining whether the coolant temperature reaches a warm-up reference temperature before the EGR use determination step.

In another aspect of the present invention, a method for controlling a cooling system in a vehicle, may include an Exhaust Gas Recirculation (EGR) use determination step of determining whether to use the EGR; a first coolant temperature management step of controlling a coolant temperature using a first coolant temperature map based on an output value reflecting engine operating conditions when driving the vehicle using the EGR; an input step of receiving a value of $NO_x$ as an input; and a third coolant temperature management step of controlling the coolant temperature using a third coolant temperature map in which a coolant temperature of the third coolant temperature map is set to be lower than a coolant temperature of the first coolant temperature map in a same engine operation region when the value of the $NO_x$ is higher than a reference value for the $NO_x$ of a $NO_x$ map set according to an engine operation region.

The method may further include a second coolant temperature management step for controlling a coolant temperature using a second coolant temperature map in which a coolant temperature is set to be higher than the coolant temperature of the first coolant temperature map in a same engine operation region when driving the vehicle not using the EGR.

The first coolant temperature management step controls the coolant temperature to be maintained within a first reference temperature range; wherein the second coolant temperature management step controls the coolant temperature to be maintained within a second reference temperature range that is higher than the first reference temperature range; and wherein the third coolant temperature management step controls the coolant temperature to be maintained within a third reference temperature range that is lower than the first reference temperature range.

The value of the $NO_x$ is determined by using a predetermined $NO_x$ model.

When the value of the $NO_x$ is lower than the reference value for the $NO_x$ of the $NO_x$ map, the coolant temperature is controlled using the first coolant temperature map.

The method may further include a warm-up determination step of determining whether the coolant temperature reaches a warm-up reference temperature before the EGR use determination step.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A method for controlling a cooling system in a vehicle according to various embodiments of the present invention is configured to include an EGR use determination step (S20), a first coolant temperature management step (S30), and a second coolant temperature management step (S40).

Figure 2:
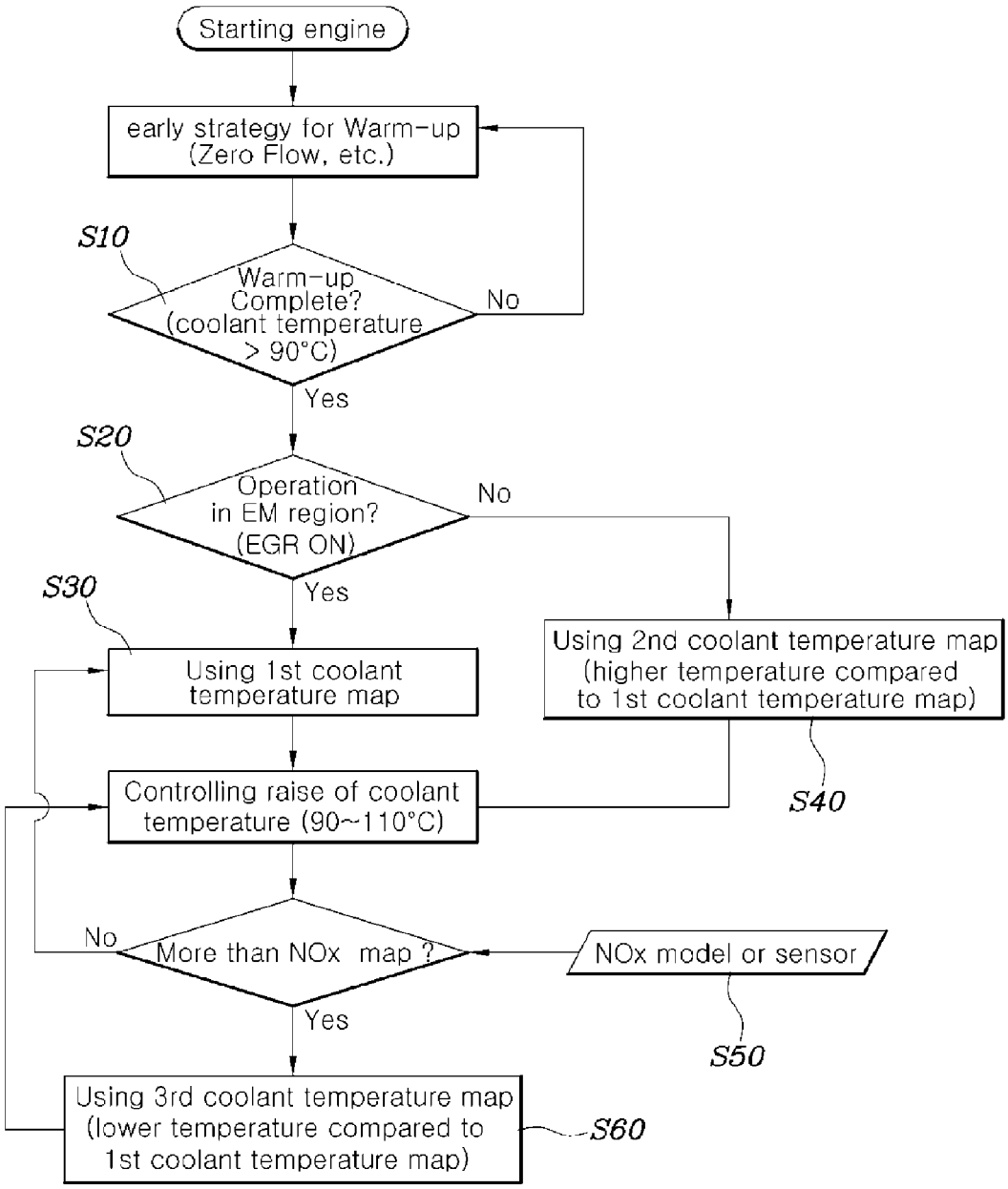
FIG. 2 is a flow diagram illustrating a control flow of the exemplary method for controlling a cooling system in a vehicle according to an exemplary embodiment of the present invention.

Referring to FIG. 2, in the EGR use determination step (S20), whether to use EGR is determined.

Desirably, in the EGR use determination step, it may be determined whether an engine is being operated in an EM region, which is an operating point of a mode used for measuring engine exhaust gas, or whether the engine is being operated in a non-EM region excluding the EM region.

Also, before the EGR use determination step (S20), the warm-up determination step (S10) may be further included to determine whether a temperature of the coolant has reached a reference temperature for warm-up.

For example, in the early stage of a cold start of a vehicle, when the coolant temperature measured by a coolant temperature sensor is less than the reference temperature for warm-up, a flow stagnation (Zero flow) control, which closes all flow channels by operating a coolant flow control valve to stop flow of the coolant inside the engine, may be performed to quickly raise the coolant temperature. Accordingly, when the coolant temperature is more than the reference temperature for warm-up through the flow stagnation control, it is possible to control the raising of the coolant temperature within a constant temperature range.

In other words, if it is determined that EGR is used in the EGR use determination step (S20), the coolant temperature may be maintained within a constant temperature range using a first coolant temperature map based on an output value reflecting engine operating conditions in the first coolant temperature management step (S30).

In this case, the engine operating conditions may be engine rpm and engine load (a fuel use amount or an amount of depression of an accelerator pedal), and it is possible to set the first coolant temperature map according to the engine operating conditions.

Figure 1:
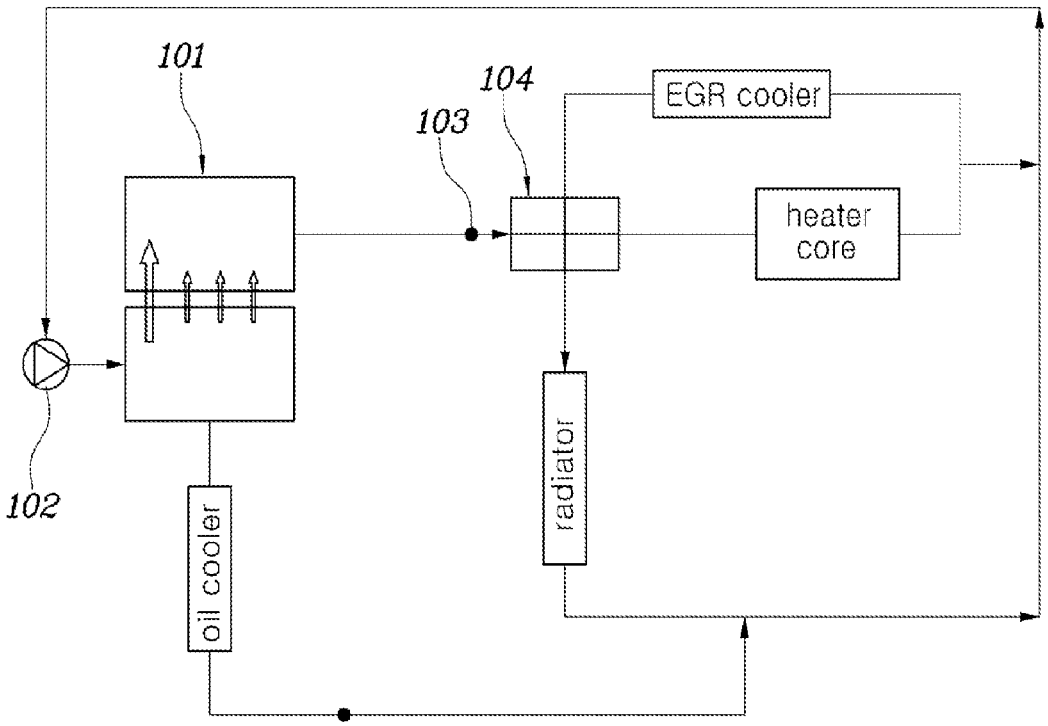
FIG. 1 (Related Art)
FIG. 1 is a simplified diagram of a cooling system in a vehicle.

For example, using the first coolant temperature map, it is necessary to raise the coolant temperature to a constant temperature range (for example, 90~110° C.) within the endurance limit of the engine, and the cooling system illustrated in FIG. 1 may be used for this.

In other words, as opening and closing of the coolant flow control valve is controlled according to the output value reflecting the engine operating conditions, the coolant flow to respective flow channels is controlled, whereby it is possible to control the coolant temperature to be maintained within a constant temperature range.

Consequently, the coolant temperature is maintained to be higher than when controlling a coolant temperature using a fixed coolant temperature map, and thus engine combustion performance and fuel efficiency may be improved.

On the other hand, if it is determined that EGR is not used in the ESG use determination step (S20), the second coolant temperature management step (S40) is performed. In the second coolant temperature management step (S40), the temperature of the coolant may be maintained within a constant temperature range using a second coolant temperature map in which the coolant temperature is set to be higher than the coolant temperature of the first coolant temperature map in the same engine operation region.

In this case, the second coolant temperature map may be set based on the engine operating conditions, or by revising the coolant temperature set in the first coolant temperature map.

In other words, when the engine is operated in the non-EM region in which EGR is not used, there is no need to consider the increase of $NO_x$. Consequently, for maximum improvement of fuel efficiency, the coolant temperature is maintained to be high using the second coolant temperature map, which enables control of the coolant temperature to be as high as possible within the endurance limit of the engine, whereby the fuel efficiency is improved in comparison with the method of controlling the coolant temperature using the first coolant temperature map.

On the other hand, when operating the engine using EGR, various aspects of the present invention may reduce $NO_x$, emissions by changing a coolant temperature map that controls the coolant temperature depending on $NO_x$ emissions, and may be configured to include an input step (S50) and the third coolant temperature management step (S60) for this.

Referring to FIG. 2, in the input step (S50), a value for $NO_x$ is input.

In this case, the predetermined $NO_x$ model may be used for the value for $NO_x$, or a value measured by a $NO_x$ sensor may be input.

Also, in the third coolant temperature management step (S60), when the value for $NO_x$ is higher than a reference value for $NO_x$ of a $NO_x$ map set according to the engine operation region, the coolant temperature may be controlled using the third coolant temperature map, in which the coolant temperature is set lower than the coolant temperature of the first coolant temperature map in the same engine operation region.

In this case, the third coolant temperature map may be set by the engine operating conditions, or by revising the coolant temperature set in the first coolant temperature map.

In other words, when $NO_x$ model or a value for $NO_x$ output from the sensor is higher than a reference value for $NO_x$ of a $NO_x$ map set according to the engine operation region, the coolant temperature is controlled using the third coolant temperature map having the lower coolant temperature compared to the first coolant temperature map, and thus $NO_x$ emissions may be reduced.

When $NO_x$ model or a value for $NO_x$ output from the sensor is lower than a reference value for $NO_x$ of a $NO_x$ map set according to the engine operation region, the coolant temperature is controlled using the first coolant temperature map.

In the various embodiments of the present invention, the first coolant temperature management step (S30) controls the coolant temperature to be maintained within a first reference temperature range.

Also, the second coolant temperature management step (S40) controls the coolant temperature to be maintained within the second reference temperature range, which is higher than the first reference temperature range. Also, the third coolant temperature management step (S60) controls the coolant temperature to be maintained within the third reference temperature range, which is lower than the first reference temperature range.

In this case, a temperature within the first, second, and third reference temperature range may be a temperature within a constant temperature range (90~110° C.).

As described above, the present disclosure controls a coolant temperature to be as high as possible using a coolant temperature map corresponding to engine operating conditions according to whether to use EGR or $NO_x$ emission, and thus improves the engine combustion performance and fuel efficiency compared to a method of controlling a coolant temperature using a fixed coolant temperature map. Also, EM (Emissions) performance may be improved by reducing $NO_x$ emissions.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method for controlling a cooling system in a vehicle, comprising:

an Exhaust Gas Recirculation (EGR) use determination step of determining whether to use EGR;

a first coolant temperature management step of controlling a coolant temperature using a first coolant temperature map based on an output value reflecting engine operating conditions when driving the vehicle using the EGR;

a second coolant temperature management step of controlling the coolant temperature using a second coolant temperature map in which a coolant temperature of the second coolant temperature map is set to be higher than a coolant temperature of the first coolant temperature map in a same engine operation region when driving the vehicle not using the EGR;

an input step for receiving a value of $NO_x$ as an input; and a third coolant temperature management step of controlling the coolant temperature using a third coolant temperature map in which a coolant temperature of the third coolant temperature map is set to be lower than the coolant temperature of the first coolant temperature map in a same engine operation region when the value of the $NO_x$ is higher than a reference value for the $NO_x$ of a $NO_x$ map set according to an engine operation region.

2. The method of claim 1, wherein the value of the $NO_x$ is determined by using a predetermined $NO_x$ model.

3. The method of claim 1, wherein when the value of the $NO_x$ is lower than the reference value for the $NO_x$ of the $NO_x$ map, the coolant temperature is controlled using the first coolant temperature map.

4. The method of claim 1, wherein the first coolant temperature management step controls the coolant temperature to be maintained within a first reference temperature range, wherein the second coolant temperature management step controls the coolant temperature to be maintained within a second reference temperature range that is higher than the first reference temperature range, and wherein the third coolant temperature management step controls the coolant temperature to be maintained within a third reference temperature range that is lower than the first reference temperature range.

5. The method of claim 1, further comprising a warm-up determination step of determining whether the coolant temperature reaches a warm-up reference temperature before the EGR use determination step.

6. A method for controlling a cooling system in a vehicle, comprising:

an Exhaust Gas Recirculation (EGR) use determination step of determining whether to use the EGR;

a first coolant temperature management step of controlling a coolant temperature using a first coolant temperature map based on an output value reflecting engine operating conditions when driving the vehicle using the EGR;

an input step of receiving a value of $NO_x$ as an input;

a second coolant temperature management step for controlling a coolant temperature using a second coolant temperature map in which a coolant temperature is set to be higher than the coolant temperature of the first coolant temperature map in a same engine operation region when driving the vehicle not using the EGR; and a third coolant temperature management step of controlling the coolant temperature using a third coolant temperature map in which a coolant temperature of the third coolant temperature map is set to be lower than a coolant temperature of the first coolant temperature map in a same engine operation region when the value of the $NO_x$ is higher than a reference value for the $NO_x$ of a $NO_x$ map set according to an engine operation region.

7. The method of claim 6, wherein the first coolant temperature management step controls the coolant temperature to be maintained within a first reference temperature range;

wherein the second coolant temperature management step controls the coolant temperature to be maintained within a second reference temperature range that is higher than the first reference temperature range; and wherein the third coolant temperature management step controls the coolant temperature to be maintained within a third reference temperature range that is lower than the first reference temperature range.

8. The method of claim 6, wherein the value of the $NO_x$ is determined by using a predetermined $NO_x$ model.

9. The method of claim 6, wherein when the value of the $NO_x$ is lower than the reference value for the $NO_x$ of the $NO_x$ map, the coolant temperature is controlled using the first coolant temperature map.

10. The method of claim 6, further comprising, a warm-up determination step of determining whether the coolant temperature reaches a warm-up reference temperature before the EGR use determination step.

* * * * *